US007654938B2

(12) United States Patent
Webber et al.

(10) Patent No.: US 7,654,938 B2
(45) Date of Patent: Feb. 2, 2010

(54) EXERCISE MACHINE WITH PIVOTING USER SUPPORT HAVING MULTIPLE PIVOT LINKAGE

(75) Inventors: Randall T. Webber, La Jolla, CA (US); Christopher E. Brennan, Santee, CA (US); Bruce Hockridge, San Diego, CA (US); Jeffrey O. Meredith, San Diego, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 74 days.

(21) Appl. No.: 12/133,116

(22) Filed: Jun. 4, 2008

(65) Prior Publication Data

US 2008/0234110 A1 Sep. 25, 2008

Related U.S. Application Data

(62) Division of application No. 10/633,805, filed on Aug. 4, 2003, now Pat. No. 7,594,880.

(51) Int. Cl.
*A63B 21/00* (2006.01)

(52) U.S. Cl. ..... 482/72; 482/95; 482/96

(58) Field of Classification Search ..... 482/72, 482/71, 95, 96, 110
See application file for complete search history.

(56) References Cited

U.S. PATENT DOCUMENTS

| | | | |
|---|---|---|---|
| 2,145,940 | A | 2/1939 | Marlowe |
| 4,441,708 | A | 4/1984 | Brentham |
| 4,641,833 | A | 2/1987 | Trethewey |
| 4,743,010 | A | 5/1988 | Geraci |
| 4,822,038 | A | 4/1989 | Maag |
| 4,844,456 | A | 7/1989 | Habing et al. |
| 4,944,641 | A | 7/1990 | Alves |

(Continued)

FOREIGN PATENT DOCUMENTS

| | | |
|---|---|---|
| CA | 2075331 | 2/1994 |

OTHER PUBLICATIONS

U.S. Appl. No. 12/212,090 of Webber et al., filed Sep. 17, 2008.

(Continued)

*Primary Examiner*—Jerome Donnelly
(74) *Attorney, Agent, or Firm*—Procopio, Cory, Hargreaves & Savitch LLP

(57) ABSTRACT

An exercise machine has a main frame, a user support frame which supports a user in an exercise position, and a multiple pivot assembly pivotally mounting the user support frame for movement between a start position and an end position. The pivot assembly has multiple pivots which define a theoretical pivot axis of the user support pivotal movement and a vertical gravitational center line which extends through the theoretical pivot axis. The user support frame has at least a primary support and a secondary support for supporting spaced positions on a user's body throughout an exercise movement. A user engagement device is movably mounted relative to the frames for engagement by the user in performing exercises, and a multiple part connecting linkage translates movement of the user engagement device to rotational movement of the user support frame. A load resists movement of at least one of the user support, user engagement device, and connecting linkage.

30 Claims, 2 Drawing Sheets

U.S. PATENT DOCUMENTS 4,949,958 A 8/1990 Richey
5,254,067 A 10/1993 Habing et al.
5,330,404 A 7/1994 Lopeteguy et al.
5,330,405 A 7/1994 Habing et al.
5,342,270 A 8/1994 Jones
5,352,171 A 10/1994 Lin
5,354,248 A 10/1994 Rawls et al.
5,356,358 A 10/1994 Chen
D357,041 S 4/1995 McBride et al.
5,417,634 A 5/1995 Habing
5,478,298 A 12/1995 Chen
5,520,599 A 5/1996 Chen
5,527,243 A 6/1996 Chen
5,527,250 A 6/1996 Chen
5,533,953 A 7/1996 Lui et al.
D372,509 S 8/1996 Yang
5,547,444 A 8/1996 Huang et al.
5,573,482 A 11/1996 Wang et al.
5,580,340 A 12/1996 Yu
5,582,563 A 12/1996 Fan
5,616,105 A 4/1997 Wang et al.
5,626,542 A 5/1997 Dalebout et al.
5,643,147 A * 7/1997 Huang ..... 482/72
5,669,865 A 9/1997 Gordon
5,674,161 A 10/1997 Lin
5,676,626 A 10/1997 Huang
5,683,334 A 11/1997 Webber
5,690,593 A 11/1997 Huang
5,720,695 A 2/1998 Eckmann
5,722,918 A 3/1998 Lee
5,810,698 A 9/1998 Hullett et al.
5,897,467 A 4/1999 Habing et al.
5,899,836 A 5/1999 Chen
5,938,570 A 8/1999 Maresh
5,944,641 A 8/1999 Habing
5,961,427 A 10/1999 Habing et al.
5,971,901 A 10/1999 Shaw
6,004,247 A 12/1999 Webber
6,135,930 A 10/2000 Kuo
6,142,914 A 11/2000 Crawford et al.
6,162,153 A 12/2000 Perez et al.
6,264,588 B1 7/2001 Ellis
6,312,366 B1 11/2001 Prusick
6,605,024 B2 8/2003 Stearns
6,752,748 B1 6/2004 Scotti
6,811,522 B1 11/2004 McQuinn
6,855,098 B2 2/2005 Reitz et al.
6,913,565 B2 7/2005 Mitchell et al.
6,916,278 B2 7/2005 Webber
6,971,978 B2 12/2005 Hyder
7,052,444 B2 5/2006 Webber
7,052,446 B2 5/2006 Morris et al.
7,070,545 B2 7/2006 Lull et al.
7,108,641 B2 9/2006 Pertegaz-Esteban
7,141,003 B2 11/2006 Wu
7,141,008 B2 11/2006 Krull et al.
7,220,221 B2 5/2007 Mosimann et al.
7,223,213 B2 5/2007 Golesh
7,229,389 B2 6/2007 Hong
7,322,906 B2 1/2008 Webber
7,331,911 B2 2/2008 Webber et al.
7,335,140 B2 2/2008 Webber et al.
7,357,768 B2 4/2008 Marshall
7,361,125 B2 4/2008 Webber et al.
7,384,381 B2 6/2008 Webber et al.
7,468,024 B2 12/2008 Webber et al.
2002/0013199 A1 1/2002 Giannelli et al.
2002/0187879 A1 12/2002 Ball et al.
2003/0199362 A1 10/2003 Chamberlin
2004/0005966 A1 1/2004 Chen
2005/0032611 A1 2/2005 Webber et al.
2006/0247107 A1 11/2006 Carter
2006/0276313 A1 12/2006 Hong
2007/0232462 A1 10/2007 Webber et al.
2007/0293377 A1 12/2007 Webber et al.
2007/0293378 A1 12/2007 Webber et al.
2008/0058176 A1 3/2008 Webber et al.
2008/0132389 A1 6/2008 Webber et al.
2008/0153677 A1 6/2008 Webber et al.
2008/0182732 A1 7/2008 Webber et al.
2008/0214365 A1 9/2008 Webber et al.
2008/0214367 A1 9/2008 Webber et al.
2008/0220950 A1 9/2008 Webber et al.
2008/0242517 A1 10/2008 Webber et al.
2008/0248929 A1 10/2008 Webber et al.

OTHER PUBLICATIONS

Office Action dated Jun. 30, 2008 in U.S. Appl. No. 11/849,028.

* cited by examiner

EXERCISE MACHINE WITH PIVOTING USER SUPPORT HAVING MULTIPLE PIVOT LINKAGE

RELATED APPLICATION

The present application is a Divisional of co-pending U.S. patent application Ser. No. 10/633,805 filed on Aug. 4, 2003, the contents of which are incorporated herein by reference in their entirety.

BACKGROUND

1. Field of the Invention

This invention relates generally to exercise machines, and is particularly concerned with an exercise machine with a pivoting user support.

2. Related Art

Movable user supports linked to the movement of an exercise arm are extremely common in exercise machines. U.S. Pat. No. 2,252,156 of Bell and U.S. Pat. No. 6,251,047 of Stearns show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement. U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in multi-purpose exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another multi-purpose exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight will oppose the user when starting an exercise from rest. Neither of these machines has any capability for aligning the user and user support with a rigid exercise arm, and thus do not maintain or support the user in the proper position throughout the exercise.

Gordon shows a multi-purpose exercise machine that has a hinged, two-piece user support that folds and unfolds with each exercise repetition. The user support consists of a seat portion and a backrest portion, which are pivotally connected together. The user support is pivotally connected to a main frame, as is a first exercise arm. This first exercise arm provides pressing and pulldown exercises. A second exercise arm is pivotally connected to the user support for providing leg exercises. This second arm travels with the seat portion of the user support. A connecting link pivotally connects the first exercise arm with the user support so that movement in the arm forces movement in the user support. The link connects to the user support at the same pivot that joins the seat portion with the backrest portion. In a second embodiment a flexible line connects the user support with the main frame and has user-engaging handles attached to one end so that movement to the handles results in movement to the user support. In this design, the flexible line acts as both connecting link and exercise arm. In both designs, the seat and backrest do not travel in a fixed relationship to each other and additional support such a footrest, safety belts and thigh gripping surfaces are required to keep the user properly and safely positioned in the user support. Because most of the combined weight of the user and user support remain on one side of the user support's gravitational centerline, this weight is used as partial exercise resistance. Movement of the user support is designed to be an exercise of its own, rather than providing proper positioning/alignment of the user relative to the exercise arm. The folding and unfolding of the two-piece user support constantly works the abdominal and low back muscles, which means that these muscles are being worked even when other exercises are being performed. The user cannot truly isolate any one specific muscle or muscle group. The stomach cannot be worked without working the low back, the arms, chest, shoulders, upper back and legs all must be worked with one another or at the least with both the stomach and low back. Because of this the user cannot fully fatigue other muscles as the abdominals and low back would fatigue first.

Current exercise machines with pivoting or movable user supports often do not accurately maintain proper positioning of the user throughout the exercise motion, can result in awkward hand or wrist positions, and often involve exaggerated and unnatural arcing movements, or linear, non-arcing arm movements, rather than the smaller elliptical movement associated with free weight or natural exercise movements. There is no provision for proper positioning of the user relative to the position of the user engaging portion of the exercise arm throughout the entire exercise motion. Often, an awkward starting or finishing position is required, potentially causing strain or injury.

SUMMARY

Embodiments described herein provide for an exercise machine with a main frame and a user support frame which is pivotally mounted on the main frame via a multiple part pivot mounting assembly having multiple pivots defining a combined or theoretical pivot axis about which the user support frame rotates.

According to one aspect, an exercise machine comprises a stationary main frame, a user support frame pivotally mounted relative to the main frame via a multiple pivot assembly to move between exercise start and end positions with a user supported in an exercise position on the user support frame, a user engagement device movably mounted relative to the frames for actuating by a user in order to perform an exercise, and a connecting linkage which links movement of the user engagement device to movement of the user support frame. A load provides resistance to movement of the user support frame, user engagement device and/or connecting linkage. The connecting linkage and pivot mounts are arranged so that movement of the exercise arm results in self-aligning movement of the user support.

In one embodiment, the multiple pivot assembly is pivotally connected between the main frame and user support frame and has multiple parts with multiple pivots which define a theoretical pivot axis of the user support pivotal movement, and a gravitational center line which extends vertically through the theoretical pivot axis. The gravitational center line is positioned so that part of the combined weight of the user and user support frame is positioned on each side of this line in at least one of the start and end positions of the pivotal movement of the user support frame. The multiple pivot assembly in one embodiment is a four bar pivot linkage.

In one embodiment, a portion of the combined weight of the user and user support frame is positioned each side of the gravitational center line in both the start and end position of the pivotal movement. A portion of the combined weight is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "drop-off" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the pivoting mechanism's gravitational center line, resulting in either a high initial lifting resistance, or else a resistance "drop off" at the end of the exercise.

The exercise machine may be designed to perform any type of exercise such as leg exercises, upper body exercises, and the like. The user engagement device may comprise one or more pivotally mounted exercise arms, or may be handles connected to one or more flexible members. In one embodiment, two exercise arms or handles may be movable in unison or independently.

The user support frame comprises primary and secondary supports which support spaced positions on a user's body throughout an exercise. In one embodiment, the primary support is a seat pad which is at a first orientation in the exercise start position and at a second orientation in the exercise end position. In one embodiment, the first orientation is horizontal or slightly reclined and the second orientation is inclined forward, so that the seat rotates through a horizontal orientation during the exercise. The secondary support may comprise an upright support pad for the user's back or chest, or may be an upright member with hold down pads for extending over the user's thighs. In another embodiment, the user support frame may be designed for supporting a user in a position to perform leg exercises. Because the user support frame moves in conjunction with the exercise arm or user engagement device, the arcuate path of the exercise arm relative to the user support frame is reduced. The result is a more natural feeling exercise movement that more closely replicates the movement found in the corresponding free weight exercise.

The arm or user engagement device may be movably associated with the user support frame, the main frame, or with a part of the connecting linkage. The user engagement device may be a bi-directional exercise arm. The multiple part connecting linkage translates movement of the user engagement device to rotational movement of the user support frame.

The exercise resistance or load may comprise a weight stack, weight plates mounted on pegs, or other types of resistance such as hydraulic, pneumatic, electromagnetic, or elastic bands, and may be associated with any of the moving parts, i.e. the user support frame, exercise arm, or connecting linkage.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 2:
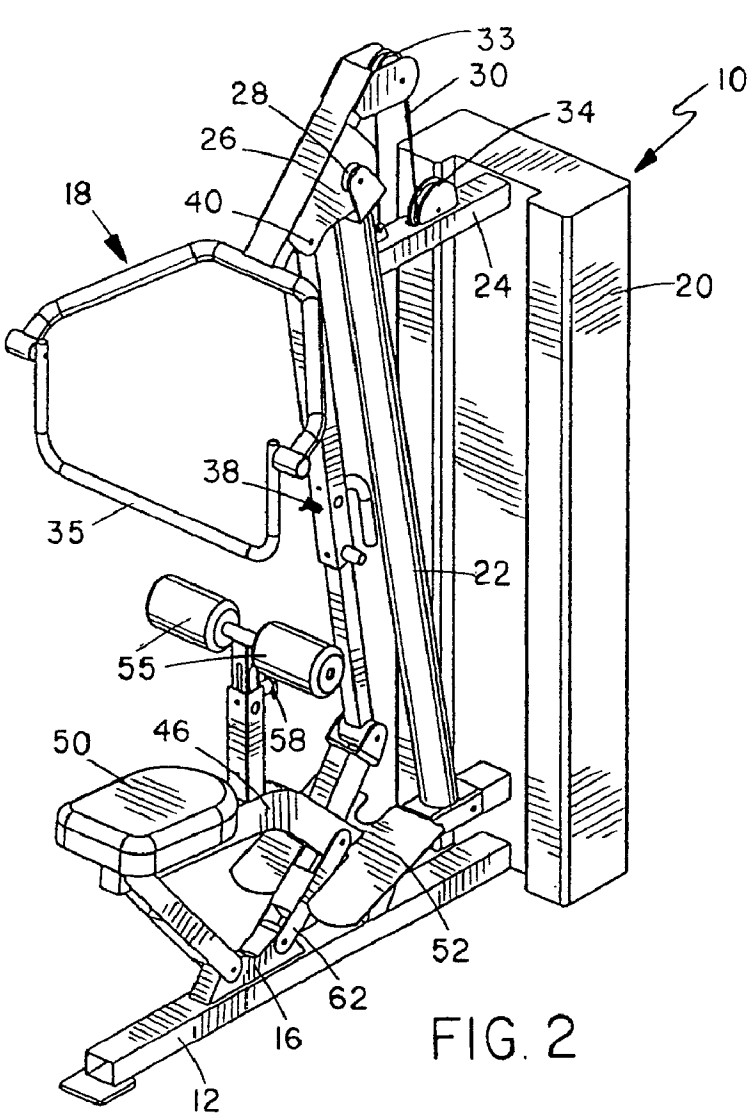
FIG. 2 is a perspective view similar to FIG. 1, illustrating the machine in an exercise end position.

Certain embodiments as disclosed herein provide for an exercise machine having an exercise arm or user engagement device and user support frame which travel in a dependent relationship. The exercise machines in the embodiments disclosed herein have a user support frame pivotally mounted on a main frame via a multiple pivot assembly, and a connecting linkage which translates movement of a user engagement device to movement of the user support frame. The exercise machines disclosed herein have a pivoting user support frame having a multiple pivot mount defining a theoretical pivot axis of the pivotal movement, and are designed to automatically align with movement of the exercise arm or user engagement device and to provide appropriate positioning of the user throughout the entire exercise movement.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 4 illustrate a rigid arm pull down machine 10 which allows a user to perform chin up type exercises similar to the free body weight exercise performed by a user pulling themselves up from the ground while gripping an overhead bar or "chinning" bar, with the user raising their body until their chin touches the bar. The exercise carried out with the machine 10 mimics the natural body alignment in the start and finish positions of a free body weight chin up exercise, as explained in more detail below.

The machine 10 comprises a main frame having a horizontal base section 12 with a rear end and a forward end, an upright section 14 at the forward end of the frame (the end to which the user faces when performing an exercise), a generally T-shaped user support frame 15 pivotally mounted on the base section via pivot mount 16, and a user engagement device or exercise arm 18 pivotally mounted at the top of the upright section 14 of the frame. The upright section 14 of the frame includes a vertical housing 20 containing a weight stack (not visible in the drawings), and a slightly forwardly inclined upright strut 22. A horizontal strut 24 extends between the top of housing 20 and the upright strut 22.

The exercise arm 18 comprises a generally U-shaped member 25 with a forwardly projecting arm 26 extending from the mid-point of the U-shaped member and pivoted to the upper end of strut 22 via pivot 28 at a mid point in its length. The forward end of arm 26 is linked to the weight stack (not visible in the drawings) via a cable 30 extending from anchor 32 on the horizontal strut 24, over a pulley 33 at the end of arm 26, then back around pulley 34 on strut 24 and via additional pulleys (not visible in the drawings) to the top of the weight stack. A U-shaped handle bar 35 is pivoted at pivot 36 to the ends of the U-shaped member 25 so as to be suspended downwardly from bar 25 for gripping by a user.

An adjustable length, multiple part connecting linkage 38 pivotally connects the exercise arm 18 to the user support frame 15. The link 38 has a first end pivoted to the forward portion 26 of the exercise arm at pivot 40, and a second end pivoted to the user support frame 15 at pivot 42. The link 38 comprises two telescopically engaging parts 80, 82 which are secured together at a selected extension via a spring loaded pull pin 44 engaging in a selected opening 45 in one of the telescoping parts.

The generally T-shaped user support frame 15 has a base member 46 and an upright member 48 projecting upwardly from the central region of member 46. A seat pad or primary support 50 is mounted on the base member 46 to the rear of upright member 48. At least one secondary or additional support is also mounted on the user support frame. In this embodiment, one secondary or additional user support comprises a pair of roller or thigh hold down pads 55 on a strut 56 telescopically mounted in member 48. The position of the roller pads 55 can be adjusted by moving strut 56 up or down and then securing it in position via a spring loaded pull pin 58. Another secondary or additional user support comprises a foot rest 52 mounted at the forward end of member 46. The connecting link pivot 42 is provided on a pivot bracket 54 adjacent foot rest 52.

Figure 4:
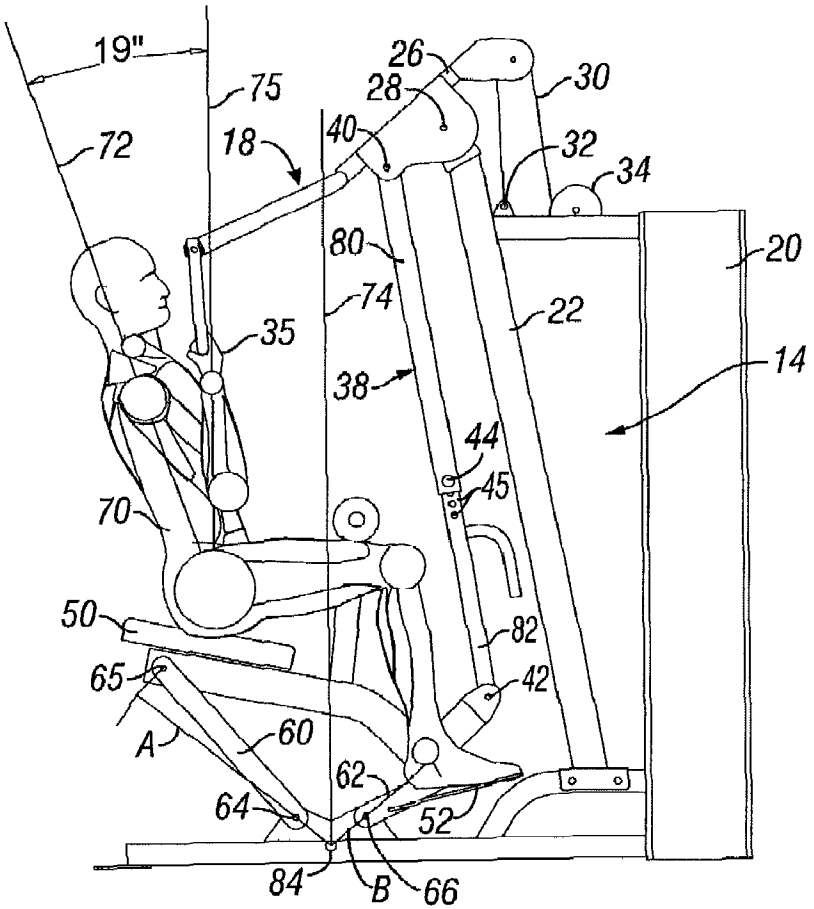
FIG. 4 is a side elevation view similar to FIG. 3, illustrating the exerciser's body position at the end of the pull down exercise.
Figure 3:
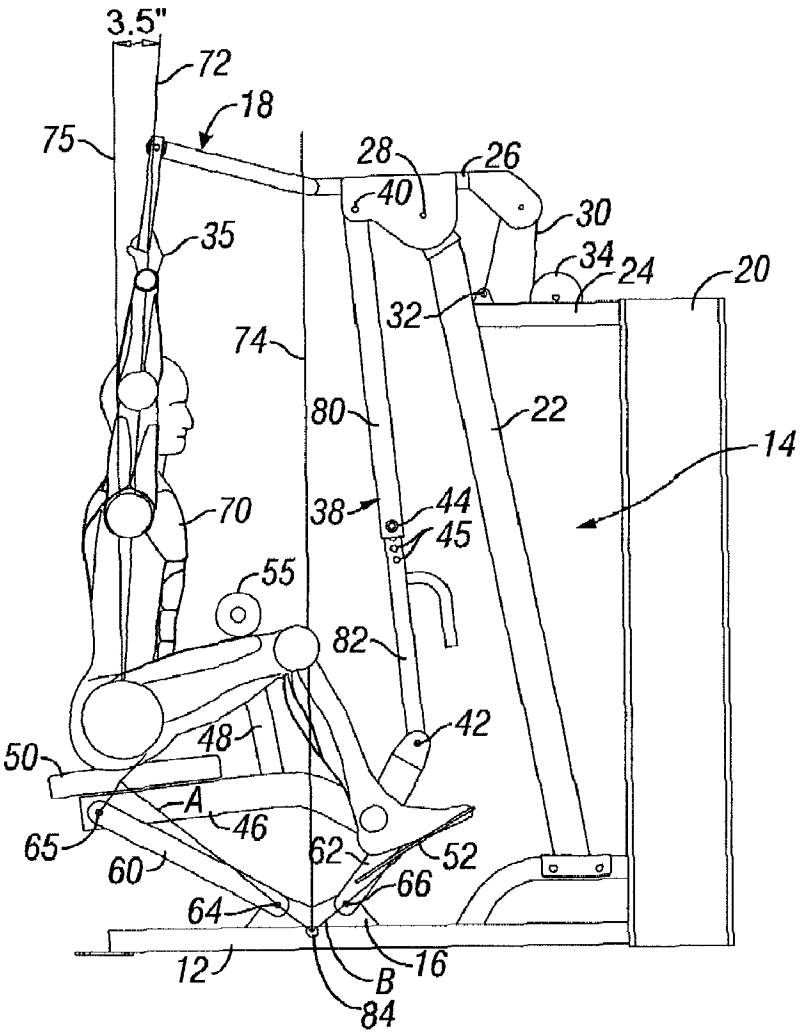
FIG. 3 is a side elevation view of the machine of FIGS. 1 and 2, illustrating an exerciser's body position at the start of the exercise.

The user support frame is pivotally mounted on base 12 via a four bar linkage system or pivot assembly comprising the base strut 46 of the user support, the pivot mount 16, and a pair of lever arms 60, 62 each pivotally connected between the pivot mount 16 and the user support base strut 46. The first lever arm 60 is pivoted at one end to the rear end of pivot mount 16 via pivot 64, and to the rear end of base strut 46 at the opposite end, via pivot 65. The second lever arm 62 is pivoted at one end to the forward end of the pivot mount 16 via pivot 66, and at the opposite end to the forward end of the base strut 46 via pivot 68. The multiple part pivot assembly defines a theoretical pivot axis of the user support pivotal motion. As illustrated in FIGS. 3 and 4, the theoretical pivot axis 84 is located below the user support, and a theoretical gravitational center line 74 of the pivotal motion extending through pivot axis 84 also extends through the user support frame 15. The location of the theoretical pivot axis 84 can be determined from the start and end positions of the two pivot links 60 and 62, and is the point of intersection of the centerline A of the pivotal movement of the forward link 62 and the centerline B of the pivotal movement of the rear link 60, as indicated in FIGS. 3 and 4.

Figure 1:
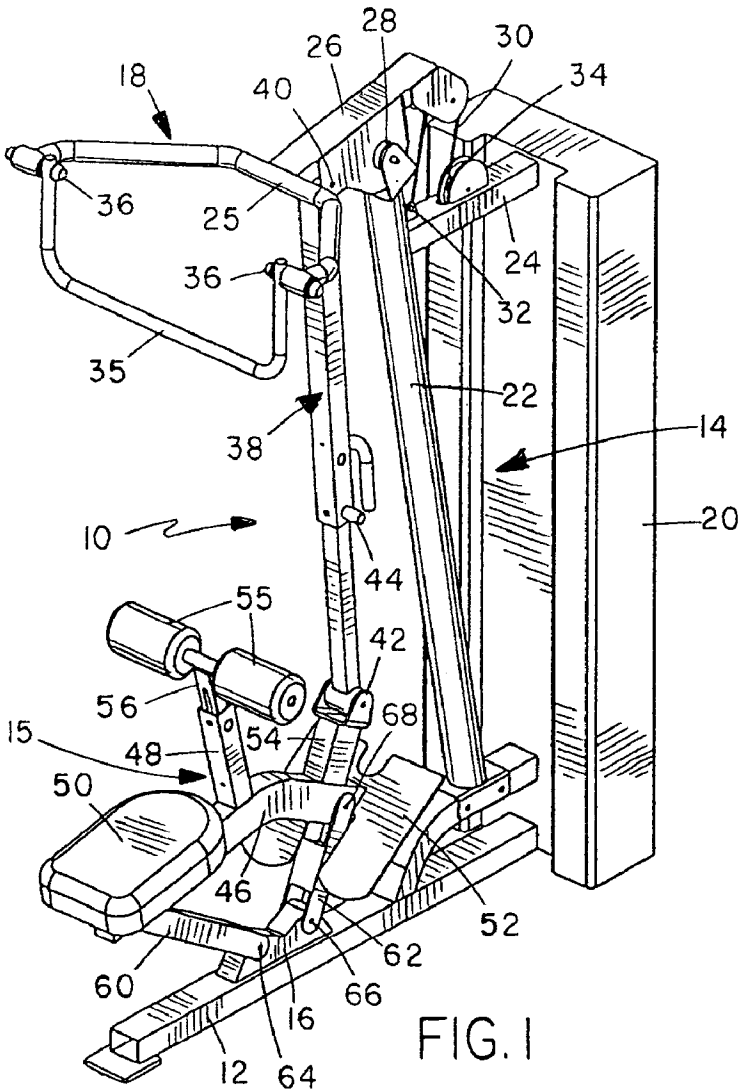
FIG. 1 is a rear perspective view of an exercise machine according to a first embodiment for performing a rigid arm pull down or lat exercise, with the machine illustrated in a start position adopted at the beginning of an exercise movement.

FIG. 1 illustrates the start position of the rigid arm pull down machine without an exerciser, while FIG. 2 illustrates the end position. FIGS. 3 and 4 illustrate the same positions with the user 70 in place to perform a chin up exercise. To perform the exercise, the user sits on seat pad 50, which starts in a slightly downwardly or rearwardly reclined orientation as illustrated in FIG. 3. They then slide their legs under the thigh hold down roller pads 55, adjusting the position of these pads by sliding the strut 56 up and down if necessary, and place their feet on the user support footrest or plate 52. They then grab the handle bar 35 of the exercise arm 18 and pull it downwards. The starting position of FIG. 3 places the user's upper body in a slightly forward lean with their arms extending straight overhead, in line with the side center line 72 of their body. If necessary, the user can adjust the distance between the user support seat 50 and exercise arm bar or handle 35 by adjusting the length of connecting link 38.

As the exercise arm 18 moves downwards, rotating about the pivots 28 and 40, the connecting link 38 pushes the forward end of the user support frame 15 downwards, rotating the frame about the four bar linkage into the finish position illustrated in FIG. 4, in which the seat pad 50 is moved into a forwardly inclined orientation. At the same time, the selected weights in the weight stack are lifted via the cable and pulley linkage between the forward end of the exercise arm and the weight stack. As the seat pad changes its orientation from a reclined angle to an inclined angle, the user automatically adjusts their upper body position rearward (relative to their angular position on the seat) to compensate for this change in seat angle, and finishes the exercise with their hands below their chin and slightly in front of their shoulders. This slight rearward movement mimics the natural rearward arc a person's upper body goes through when performing a free bar chin up. The exercise machine closely mimics the natural body alignment of an exerciser in both the start and finish positions when performing body weight exercises on a chinning bar. This provides the user with a safer and more comfortable compound exercise movement than was possible with previous rigid arm pull down exercise machines.

The user support theoretical pivot axis 84 is positioned under the user support frame such that a substantial portion of the combined weight of the user and the support frame is positioned on each side of the gravitational center line 74 of the pivot axis in both the start and end position, as illustrated in FIGS. 3 and 4. Since the pivot is a four bar linkage in the embodiment of FIGS. 1 to 4, the center line 74 is a theoretical center line of the pivotal movement. The portion of both the user and the user support positioned on each side of line 74 varies only very slightly from the start to the finish point of the exercise movement. This balanced distribution minimizes the effect that the combined weight of the user and user support has on the exercise resistance, while still allowing it to act as a counter balance to offset the weight of the exercise arm. The combined weight of the user and support have little effect on the amount of starting resistance, because a substantially equal amount of weight is balanced rearward of the user support pivot. By the same token, because only a small portion of the user passes through the gravitational center line 74 during the exercise, there is no appreciable drop off in resistance felt by the user.

The line 75 in FIGS. 3 and 4 represents the perpendicular or vertical centerline of the user in both the start and finish positions, while line 72 is the side centerline. As illustrated in FIG. 3, at the start of the exercise, the user is in a forward lean of approximately 3.5 degrees off vertical, with their arms fully extended and in line with the body side centerline. At the end of the exercise, as illustrated in FIG. 4, the user is reclining at approximately 19 degrees to the vertical centerline 75, with their hands positioned under the chin and slightly forward of their shoulders. Thus, the upper body moves through an angle of approximately 22.5 degrees, similar to the movement when performing a free chin up exercise with an overhead chinning bar. The pull down exercise machine 10 closely mimics the natural movement and body alignment found in a free bar chin up exercise.

Another advantage of this machine is the multiple user supports. The primary user support in this case is the seat pad 50, while a secondary support is provided by the thigh hold-down pads 55. A further support or stabilization means is provided by the foot pads 52 which travel with the user support frame 15. The multiple user supports help to provide proper positioning of the user relative to the user engaging portion of the exercise arm throughout the entire exercise movement. This also makes the apparatus much more comfortable and natural for the user, making the user want to exercise. The foot pads keep the user's feet in the same relaxed and supported position throughout the entire exercise movement.

The rigid arm pull down machine 10 places the user's body in a slightly forward lean at the start of the exercise, to compensate for the reclined angle of the seat, with their arms extended straight overhead and in line with their body side centerline. The body orientation changes to a reclined angle mimicking the natural rearward arc the body goes through when performing a chin up exercise, with the user finishing the exercise with their arms under their chin.

The exercise machine described above has a moving user support frame which is pivotally mounted on the main frame by a multiple pivot assembly having multiple pivoted parts which define a theoretical or combined pivot axis of the pivotal movement. In the illustrated embodiment, the multiple pivot assembly is a four bar pivot linkage, but other multiple pivot mounts may be used in alternative embodiments.

The multiple pivot assembly is designed to place the theoretical pivot axis at a desired location in order to produce a predetermined pivotal motion of the user support. It is also designed so that the vertical gravitational center line of the pivotal movement extends through the user support frame in at least one of the exercise start and end positions. In the above embodiment, the exercise machine is a rigid arm pull down machine, but other exercise machines with rocking seats may incorporate a multiple part pivot assembly as described above, such as a seated dip exercise machine, a leg press exercise machine, a shoulder press exercise machine, a chest press exercise machine, a mid-row exercise machine, a pec fly exercise machine, a rear deltoid exercise machine, or the like, as described in co-pending application Ser. No. 10/633,805 referenced above, the entire contents of which are incorporated herein by reference.

In each embodiment, the user engagement device, which comprises a rigid exercise arm in the illustrated embodiment, is linked to the user support so that movement of the user engagement device produces movement in the user support. In the illustrated embodiment, the connecting linkage is a multi-part linkage which translates movement of the user engagement device to movement of the user support. The connecting linkage may be a partially flexible linkage including one or more cables extending around pulleys, or may comprise multiple rigid parts which are pivotally or telescopically secured together and pivotally or slidably engaged with two or more of the main frame, user engagement device, and user support frame. In an alternative embodiment, the multiple part connecting linkage may be replaced by a single connecting link. Instead of a rigid exercise arm, the user engagement device may include a flexible cable extending around pulleys on the main frame or an articulated exercise arm.

In each of the above embodiments, movement of the user support is linked to movement of the exercise arm or user engagement device and the user support pivot or theoretical pivot is positioned so that the combined weight of the user support and user is distributed on both sides of the gravitational centerline of the pivot, and the user support provides a counter-balancing effect on the exercise arm as it moves and its weight is re-distributed. In one embodiment, this balanced weight distribution positions a portion of the user and user support on each side of the gravitational centerline in both the start and end positions. As the exercise arm is moved, a portion of this combined weight passes through the gravitational centerline redistributing the weight. This re-distribution is gradual and continuous throughout the exercise motion and is not noticed by the user.

In the exercise machine described above, operation of the user engagement device causes a rocking movement of the user support. Due to the position of the user support pivot, the movement of the user and user support has only a small effect on the exercise resistance felt by the user, and there is no high resistance to be overcome in starting the exercise, or large resistance drop-off. The rocking movement of the user support recruits core stabilizing muscles and also makes the exercise enjoyable to perform. Repetitious exercise movement can be tedious and boring. By adding motion to the user support, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that different types and forms of components could be used without affecting the scope of the invention. Cables could be replaced with belts, ropes, chains, or the like, and pulleys could be replaced with sprockets. The primary and secondary user supports could be fixed or made adjustable. Various different types of user engaging pads can be used. The exercise arm could be unidirectional or bi-directional, may be rigid or flexible, and may be in one piece (dependent) or two pieces for independent arm movement. The exercise arm may be mounted on the user support, main frame, or connecting linkage, and the exercise arm may travel in a rotational, linear, or user-defined path and the handle path or path of the user's hands may be linear, diverging or converging. Different user engaging handles may be used, providing rigid, flexible, fixed, or self-aligning, two dimensional or three dimensional hand movement, without affecting the overall function of the machines. The exercise arms may provide two dimensional or three dimensional handle movement.

The user support and user engagement device could be designed to travel in the same or opposite directions. The resistance may be associated with any of the moving parts (user support, user engagement device, or connecting linkage). The exercise resistance may be a weight stack linked to part of the apparatus by a cable and pulley arrangement, or may be weight plates. Any other type of resistance known in the art may alternatively be used, such as hydraulic, pneumatic, electromagnetic, or elastic bands, in place of the weight stack or weight plates.

Although the exercise machine described above is a single, stand-alone exercise machine, it may alternatively be incorporated as one of the exercise stations in a multi-station exercise machine. The exercise machine may also be a multi-function exercise machines on which different exercises may be performed. In all alternative embodiments, the multiple user support pads provide secure and safe positioning, placing the user in an appropriate exercise alignment from start to finish, without any adjustment required by the user. The primary and secondary user supports travel together in fixed alignment to keep the user in the same position throughout the exercise motion so that the user does not have to worry about balancing on a moving platform or pad.

The user support in the above embodiment is positioned relatively low to the ground in the start and end position, making the machine or station quicker, easier, and safer to enter and exit. The user does not have to climb up or down in order to get into, or out of, the exercise position. The low profile also makes the machine more economical to produce and less intimidating to the user. The combined exercise arm and user support movement produces an automatic and continuous self-aligning exercise motion that allows enhanced hand, wrist and foot positioning versus free weight and free bar exercises or prior art machines for performing equivalents of such exercises.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. An exercise machine, comprising:

a stationary main frame having an upper end, a lower end, a first end, and a second end;

a user support frame which is adapted to support a user in an exercise ready position on the main frame;

a multiple part pivot assembly pivotally mounting the user support frame relative to the main frame and having multiple pivots which together control pivotal movement of the user support frame in an arcuate exercise movement path about a central pivot axis;

the user support frame having at least a primary support and a secondary support which support spaced positions on a user's body throughout an exercise movement, the secondary support being secured at a fixed and unchanging angular orientation relative to the primary support at least throughout an exercise movement, the primary support supporting the majority of a user's weight in the start position of the support frame;

a user engagement device movably mounted relative to the frames for engagement by the user in performing exercises;

a connecting linkage which translates movement of the user engagement device during an exercise to movement of the user support frame;

a load for resisting movement of at least one of the user support, user engagement device, and connecting linkage; and the central pivot axis of the pivotal movement of the user support frame being positioned such that a gravitational center line which extends vertically through the central pivot axis also extends through the user support frame during at least part of the arcuate exercise movement path of the user support frame and only a portion of the combined weight of the user and user support frame passes through the gravitational center line during an exercise.

2. The machine of claim 1, wherein the gravitational center line extends through the user and user support frame throughout the entire arcuate exercise movement path of the user support frame during an exercise.

3. The machine of claim 1, wherein the multiple pivot assembly comprises a four bar pivot linkage.

4. The machine of claim 3, wherein the four bar pivot linkage comprises a first pivot link pivotally connected to the main frame at a first position for rotation about a first pivot axis and pivotally connected to the user support at a second position for rotation about a second pivot axis, and a second pivot link pivotally connected to the main frame at a location spaced from the first pivot axis for rotation about a third pivot axis, and pivotally connected to the user support at a location spaced from the second pivot axis for rotation about a fourth pivot axis.

5. The machine of claim 4, wherein the main frame has a base portion and both pivot links are pivotally connected to the base portion below the user support frame for rotation about the first and third pivot axes, respectively.

6. The machine of claim 5, wherein the user support frame is adapted to support the user facing the first end of the frame in the exercise ready position, the first pivot link is spaced closer to the second end of the frame than the second pivot link, and the second pivot axis is located closer to the second end of the frame than the first pivot axis in all positions of the user support frame as the user support frame moves in the arcuate exercise movement path during an exercise.

7. The machine of claim 5, wherein the fourth pivot axis is located closer to the first end of the main frame than the third pivot axis in all positions of the user support frame as the user support frame moves in the arcuate exercise movement path during an exercise.

8. The machine of claim 5, wherein the user support frame has a base portion having a first end and a second end and a seat pad is mounted on the base portion to support a seated user during an exercise, and at least the second pivot axis is located generally under the seat pad.

9. The machine of claim 8, wherein the fourth pivot axis is associated with user support base portion in the vicinity of the first end of the user support base portion.

10. The machine of claim 1, wherein the central pivot axis of the pivotal movement of the user support frame is located below the user support frame.

11. The machine of claim 1, wherein the multiple pivot assembly is located below the user engaging portion of at least the primary support of the user support frame.

12. The machine of claim 1, wherein the primary support comprises a seat pad which is adapted to support a user in an exercise ready seated position.

13. The machine of claim 12, wherein the seat pad is at a first orientation in the start position and rotates into a different orientation at the end of an exercise.

14. The machine of claim 13, wherein the seat pad moves in a forward direction between the start and end position of the exercise movement.

15. The machine of claim 12, wherein the secondary support comprises a foot rest.

16. The machine of claim 12, wherein the secondary support portion comprises a thigh hold down device which is adapted to engage the thighs of a user seated on the seat pad in said exercise ready position facing the first end of the main frame.

17. The machine of claim 1, wherein the user engagement device comprises at least one rigid exercise arm.

18. The machine of claim 17, wherein the exercise arm is pivoted to the main frame at a location above the user support frame for rotation about an exercise arm pivot axis.

19. The machine of claim 1, wherein the connecting linkage is pivotally associated with at least one of the user support frame and user engagement device.

20. The machine of claim 19, wherein the connecting linkage is pivotally connected between the user engagement device and the user support frame.

21. The machine of claim 1, wherein the connecting linkage comprises at least two rigid link members.

22. The machine of claim 21, wherein the rigid link members are adjustably engaged.

23. The machine of claim 1, wherein the central pivot axis of the pivotal movement of the user support frame is located beneath the user engaging portion of at least one of the primary and secondary user supports during at least part of an exercise movement.

24. The machine as claimed in claim 1, wherein the user support frame supports a user in a seated position and the user engagement device has at least one grip for gripping and moving by a user to perform an upper back exercise.

25. The machine of claim 1, wherein the user engagement device comprises an exercise arm portion pivoted to the main frame and a handle portion pivoted from the exercise arm.

26. The machine of claim 17, wherein the exercise arm is linked to the load.

27. The machine of claim 1, wherein the central pivot axis of the pivotal movement of the user support frame lies on a horizontal level adapted to be spaced below the hips of a user positioned in an exercise position on the user support frame through at least part of an exercise movement.

28. The machine of claim 1, wherein the exercise is an upper body exercise.

29. The machine of claim 16, whereon the user support frame further comprises a foot rest, both the foot rest and the thigh hold down device being positioned closer to the first end of the frame than at least part of the seat pad.

30. An exercise machine, comprising:

a stationary main frame;

a user support frame which is adapted to support a user in an exercise ready position;

a multiple pivot assembly pivotally mounting the user support frame which allows rotation of the user support frame during an exercise in an arcuate exercise movement path relative to the main frame from an exercise start position, the pivot assembly having multiple pivots which together control the user support frame to move in the arcuate exercise movement path about a central pivot axis during an exercise;

the user support frame having at least a primary support and a secondary support which support spaced positions on a user's body throughout an exercise movement, the secondary support being secured at a fixed and unchanging angular orientation relative to the primary support throughout an exercise movement, the primary support supporting the majority of a user's weight at least in the start position of the support frame;

a user engagement device comprising at least one rigid exercise arm pivotally mounted to the main frame at a location above the user support frame for rotation about an exercise arm pivot axis, the exercise arm extending over the user support frame;

at least one handle suspended from the exercise arm above the user support at a predetermined position for gripping by at least one hand of a user positioned on the user support with their arms extended upward in a start position for a lat pulldown exercise;

a connecting linkage which translates movement of the user engagement device during an exercise to movement of the user support frame; and a load for resisting movement of at least one of the user support, user engagement device, and connecting linkage.

* * * * *